US011105176B2

(12) United States Patent
Agour

(10) Patent No.: US 11,105,176 B2
(45) Date of Patent: Aug. 31, 2021

(54) DRILLABLE CEMENTING PLUG

(71) Applicant: Saudi Arabian Oil Company, Dhahran (SA)

(72) Inventor: NourEldeen Nabil Abdelaziz Agour, Elbagour (EG)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/661,752

(22) Filed: Oct. 23, 2019

(65) Prior Publication Data

US 2021/0123318 A1 Apr. 29, 2021

(51) Int. Cl.

| | |
|---|---|
| ***E21B 33/12*** | (2006.01) |
| ***E21B 33/16*** | (2006.01) |
| ***E21B 29/00*** | (2006.01) |

(52) U.S. Cl.

CPC ..... *E21B 33/1204* (2013.01); *E21B 29/00* (2013.01); *E21B 33/1208* (2013.01); *E21B 33/16* (2013.01); *E21B 33/165* (2020.05); *E21B 33/167* (2020.05)

(58) Field of Classification Search

CPC .... E21B 33/1204; E21B 33/134; E21B 33/16; E21B 33/165; E21B 33/167; E21B 29/00; E21B 33/1208

See application file for complete search history.

(56) References Cited

U.S. PATENT DOCUMENTS 2,043,225 A * 6/1936 Armentrout ..... E21B 49/087 166/264
2,092,041 A * 9/1937 Armentrout ..... E21B 33/136 166/100
2,173,033 A * 9/1939 Armentrout ..... E21B 43/086 166/285

(Continued)

FOREIGN PATENT DOCUMENTS

CA 870408 5/1971
CA 904741 7/1972

(Continued)

OTHER PUBLICATIONS

ERA Energy Service, "Cementing Product Catalog," ERA Energy Services Pty, Ltd, 2018, 12 pages.

(Continued)

*Primary Examiner* — Nicole Coy
(74) *Attorney, Agent, or Firm* — Fish & Richardson P.C.

(57) ABSTRACT

Cementing plugs and methods of forming cementing plugs containing a plurality of objects are disclosed. In some implementations, the cementing plug includes a body having a plurality of objects dispersed within the body. One or more of the objects may protrude from a surface of the body of the cementing plug. In some implementations, the plurality of objects may be irregularly-shaped, uniformly-shaped, or a combination of irregularly-shaped and uniformly-shaped. The plurality of objects may be randomly distributed in the body of the cementing plug or uniformly arranged in the (Continued)

body of the cementing plug. In some implementations, a portion of the plurality of objects may be uniformly arranged and another portion of the plurality of objects may be randomly distributed in the body of the cementing plug.

10 Claims, 3 Drawing Sheets

(56) References Cited

U.S. PATENT DOCUMENTS 2,203,595 A * 6/1940 Hall ..... E21B 49/088 166/116
3,550,683 A * 12/1970 Comeaux ..... E21B 33/16 166/156
3,842,905 A * 10/1974 Morrisett ..... E21B 33/1204 166/155
4,190,112 A * 2/1980 Davis ..... E21B 17/14 166/153
4,711,300 A * 12/1987 Wardlaw, III ..... E21B 29/00 166/153
4,836,279 A 6/1989 Freeman
4,979,562 A * 12/1990 Langer ..... E21B 17/14 166/156
5,433,270 A 7/1995 LaFleur
9,790,763 B2 * 10/2017 Fripp ..... E21B 33/1208

FOREIGN PATENT DOCUMENTS

WO 94/15062 7/1994
WO 2014/197827 12/2014

OTHER PUBLICATIONS

Top-Co, "Technical Sheet for Top-Co Phenolic Core Cementing Plugs," Fit-for-purpose Casing, Cementing, and Completion Solutions, revised May 2017, 2 pages.
PCT International Search Report and Written Opinion in International Appln. No. PCT/US2020/057,046, dated Feb. 19, 2021, 12 pages.

* cited by examiner

DRILLABLE CEMENTING PLUG

BACKGROUND

The present disclosure applies to cementing plugs.

SUMMARY

A first aspect of the present disclosure is directed to a cementing plug for introduction into a wellbore casing during a cementing operation. The cementing plug may include a body formed from an elastomer and a plurality of objects distributed within the body. The plurality of objects may be formed from a rigid polymeric material.

A second aspect of the present disclosure is directed to a method of forming a cementing plug for use during a cementing operation. The method may include incorporating a plurality of objects formed from a rigid polymeric material into a flowable elastomer to form a mixture; introducing the mixture into a mold such that the plurality of objects are distributed within the mixture; solidifying the mixture into a cementing plug; and removing the cementing plug from the mold.

The various aspects may include one or more of the following features. The rigid polymeric material may include Bakelite. One or more of the plurality of the objects may protrude from a surface of the body. The body may include a first flared end. At least a portion of the plurality of objects may be irregularly-shaped. At least a portion of the plurality of objects may be randomly distributed within the body. At least a portion of the plurality of objects may be uniformly-shaped. The body may include a second flared end. A base may be provided at an end of the body. The base may be formed from Bakelite. The body may include a plurality of annular rings. The body may define a central passage. At least one of the plurality of objects may be caused to protrude from a surface of the cementing plug.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DETAILED DESCRIPTION

Figure 1:
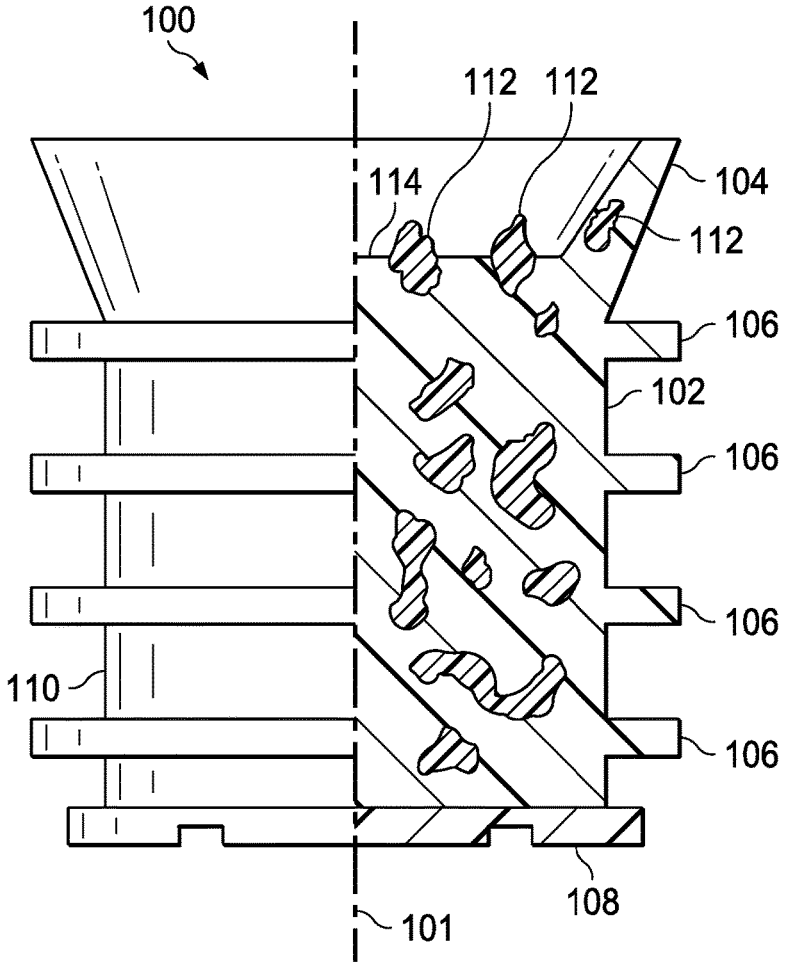
FIG. 1 is a partial cross-sectional side view of an example cementing plug, according to some implementations of the present disclosure.

The following detailed description describes cementing plugs and, particularly, cement displacement plugs. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features. Additionally, it is fully contemplated that the features, components, steps, or a combination of these described with respect to one implementation may be combined with the features, components, steps, or a combination of these described with respect to other implementations of the present disclosure.

Cementing plugs are used during a cementing operation to introduce cement into an annulus formed between an exterior surface of a well casing and an inner surface of a wellbore in order to seal the annulus. Cementing operations may use different types of plugs, such as hollow cementing plugs and solid cementing plugs. Generally, hollow cementing plugs are introduced into a well casing to clean the casing, preventing contamination of the cement. Solid cementing plugs, also referred to as cement displacement plugs, are introduced in the well casing following introduction of the cement and are used to displace cement from inside of the well casing into the annulus. Both solid and hollow cementing plugs include annular rings that form wipers. The wipers are used to clean an inner surface of the well casing as well as to form a seal between opposing sides of the cementing plug, thereby reducing or preventing contamination of the cement from other materials, such as debris or drilling mud within the casing.

Conventional cementing plugs are difficult to remove once run into a well casing during a cementing operation. For example, solid cementing plugs generally have a solid body formed from rubber and a generally smooth, flat surface at a first end. The first end of the cementing plug is positioned uphole when introduced into the well casing. Cementing plugs are removed by grinding the cementing plugs with a drill bit, such as a polycrystalline diamond compact drill bit or a roller cone drill bit. Removal in this way is referred to as drill out. However, the smooth, flat first surface and solid rubber body make conventional cementing plugs difficult to remove using drill bits. As a result, removing the conventional cementing plugs involves drilling the well plugs for an excessive amount of time, resulting in increased costs. For example, in some implementations, a time for drilling out a conventional cementing plug may be a range of two to six hours. In some cases, a drilling time in excess of six hours is needed to remove a cementing plug. Additionally, in some cases, a separate trip is needed to clean out the pieces of the ground cementing plug from inside of the well casing before a directional bottom hole assembly may be installed. Further, removal of conventional cementing plugs may involve using a different drill bit to grind up the cementing plug that what is used to form a wellbore. Using different drill bits requires additional trips with the drill string, which further increases an amount of time needed to remove the cementing plug. These delays and additional operations increase costs associated with well construction.

Figure 2:
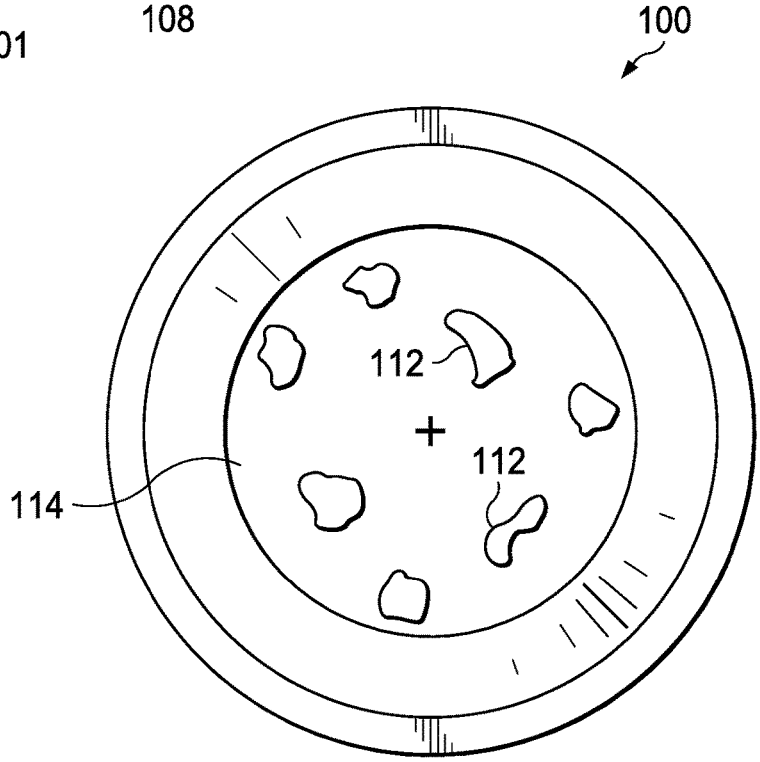
FIG. 2 is a top view of the example cementing plug of FIG. 1.

FIGS. 1 and 2 are a partial cross-sectional side view and top view, respectively, of an example cementing plug 100 within the scope of the present disclosure. In the illustrated example, the cementing plug 100 is a solid cement displacement plug and has a generally cylindrical shape about longitudinal axis 101. The cementing plug 100 has a circular cross section taken in a direction transverse to the longitudinal axis 101. The cementing plug 100 includes a body 102 having a flared first end 104 and a plurality of annular rings 106. The annular rings 106 and flared first end 104 define a plurality of wipers that operate to contact an inner surface of a well casing. The annular rings 106 and flared first end 104 are operable to clean an inner surface of a well casing and provide a seal between portions of a passage formed within the well casing on opposing sides of the cementing plug 100. The cementing plug 100 also includes a base 108 provided at a second end 110 of the body 102. In some implementations, the second end 110 may be flared. In some implementations, the body 102 is formed of an elastomer, such as rubber. In some implementations, the base 108 is formed of Bakelite. In other implementations, the base 108 may be formed from other types of rigid polymeric materials. The base 180 may include a profile configured to interlock with a downhole structure. For example, an interlocking profile of the base 180 may interlock with a profile formed on another plug disposed downhole, such as a hollow cementing plug. This interlocking profile is operable to prevent or reduce rotation of the cementing plug 100 during drill out or to prevent relative rotational movement between the cementing plug 100 and an adjacent cementing plug during drill out. Consequently, the base 108 may prevent or reduce rotation of the cementing plug 100 within the well casing during removal of the cementing plug 100 by a drill bit.

The cementing plug 100 also includes a plurality of objects 112 distributed within the body 102. In some implementations, the objects 112 are irregularly shaped and are formed from a polymeric material, preferably a brittle polymer such that the objects 112 are rigid as opposed to elastomeric. For example, the objects 112 may be formed from Bakelite. Some implementations do not include the objects 112. For example, in one implementation, the objects 112 may be sized so as to have a dimension that is within a range of one inch to three inches. For example, one or more of the objects 112 may be of a size having a dimension that is one inch, 1.5 inches, two inches, 2.5 inches, three inches, or another dimension in between these values. Still further, the objects 112 may be a mixture of one or more sizes of regularly-shaped objects and a plurality of irregularly-shaped objects of one or more sizes. Alternatively, a portion of the objects 112 may be uniformly-arranged within the body 102 while a portion of the objects 112 may be non-uniformly-arranged within the body 102.

As shown in FIG. 1, portions of some of the objects 112 are exposed at the first end 104. These exposed objects 112 result in an end surface 114 of the body 102 having an irregular shape. This irregularly-shaped end surface 114 enhances the cutting effectiveness of the cementing plug 100 by a drill bit, thereby decreasing an amount of time to remove cementing plug 100 via drilling. In other implementations, the objects 112 may be entirely contained within the body 102 such that the end surface 114 is flat. In this implementations, the objects 112 enhance removal of the plug 100 by a drill bit. As a result, even for cementing plugs 100 having objects 112 that do not protrude from a surface of the body 102, removal of the cementing plug 100 by drilling is enhanced, and a drilling time to remove the cementing plug 100 is reduced. In some instances, a time for removing a cementing plug within the scope of the present disclosure may be less than an hour or less than 30 minutes. As a result, cementing plugs within the scope of the present disclosure are subject to removal via drilling in a fraction of the time needed to remove a conventional cementing plug.

Figure 3:
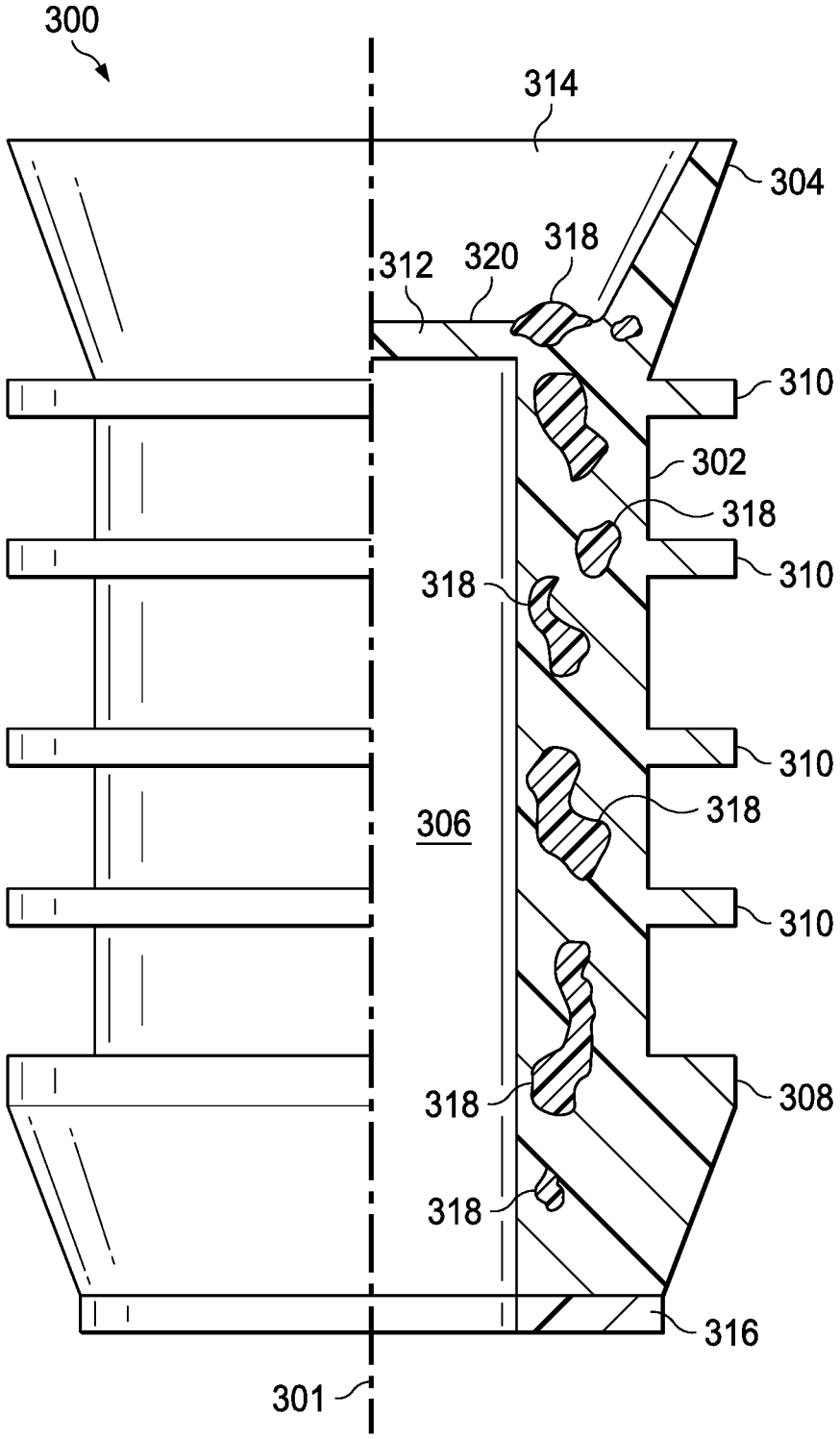
FIG. 3 is a partial cross-sectional side view of another example cementing plug, according to some implementations of the present disclosure.

FIG. 3 is another example cementing plug 300. The cementing plug 300 is a hollow cementing plug and has a generally cylindrical shape about longitudinal axis 301. The cementing plug 300 may have a circular cross section taken in a direction transverse to the longitudinal axis 301. Hollow cementing plugs, such as cementing plug 300, are generally introduced into a well casing before a solid cementing plug, such as cementing plug 200, in order to form a temporary seal within the well casing and to clean the well casing. The cementing plug 300 includes a hollow body 302 having a flared first end 304, a central passage 306 extending through the hollow body 302, a flared second end 308, a plurality of annular rings 310 that form wipers, and a partition 312 extending across the central passage 306 at the flared first end 304. The flared first end 304, the flared second end 308, and the annular rings 310 operate to contact an inner surface of a well casing. The partition 312 isolates the central passage 306 from a recess 314 formed in the flared first end 304. The partition 312 is configured to rupture at a selected pressure differential applied across opposing sides of the partition 312. The cementing plug 300 also includes a base 316 provided at the flared second end 308. In some implementations, the base 316 may be omitted. In some implementations, the second flared end 308 may be omitted.

In some implementations, the hollow body 302 may be formed from an elastomer, such as rubber. In some implementations, the base 316 may be formed from Bakelite. The base 316 may prevent or reduce rotation of the cementing plug 300 within the well casing during removal of the cementing plug 300 by a drill bit.

The cementing plug 300 also includes a plurality of objects 318 distributed within the body 102. In some implementations, the objects 318 are irregularly-shaped and formed from a polymeric material. For example, the objects 318 may be formed from Bakelite. In some implementations, the objects 318 may be sized such that a dimension of the objects 318 is within a range of one inch to three inches. For example, one or more of the objects 318 may be of a size having a dimension that is one inch, 1.5 inches, two inches, 2.5 inches, three inches, or another dimension in between these values. In still other implementations, one or more objects 318 may have a dimensional size that is greater than three inches.

The objects 318 may be sized, shaped, and arranged within the hollow body 302 as described earlier in the context of objects 112. In some implementations, a total volume occupied by the objects 112 may be +/−20 percent of the volume of the cementing plug 100. Some implementations do not include the objects 112. Additionally, a portion of one or more of the objects 318 may protrude from the hollow body 302. These exposed objects 318 result in an end surface 320 of the body 302 having an irregular shape. As explained earlier, this irregularly-shaped end surface 320 enhances the cutting effectiveness of the cementing plug 300 by a drill bit, thereby decreasing an amount of time to remove cementing plug 300 via drilling. In other implementations, the objects 318 may be entirely contained within the body 302 such that the end surface 320 is flat and all are rubber (same rubber elastomer material). As also explained earlier, the objects 318 enhance removal of the plug 300 by drilling with a drill bit. Further, even for cementing plugs 300 having objects 318 that do not protrude from a surface of the body 302, removal of the cementing plug 300 by drilling is enhanced, and a drilling time to remove the cementing plug 300 is reduced.

Figure 4:
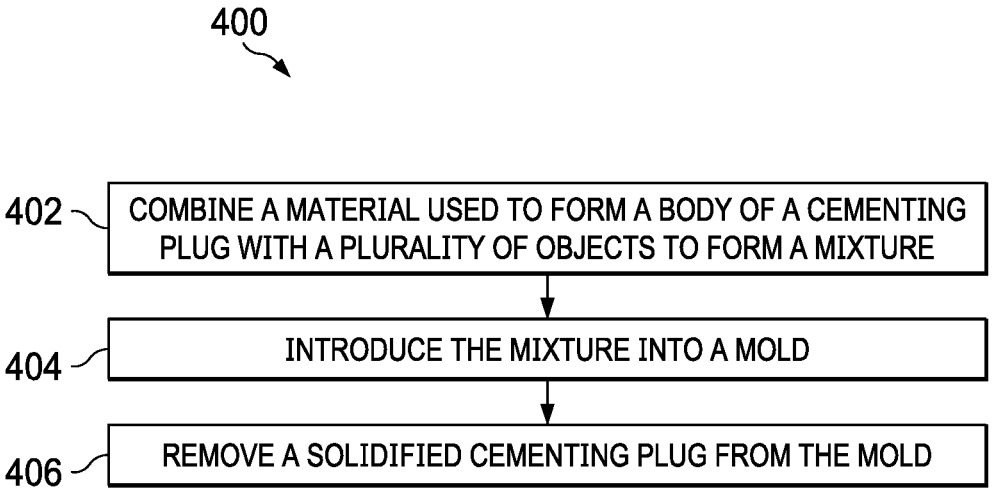
FIG. 4 is a flowchart of an example method for forming a cementing plug, according to some implementations of the present disclosure.

FIG. 4 is a flowchart of an example method 400 of manufacturing a cementing plug within the scope of the present disclosure. At 402, a material used to form a body of the cementing plug, whether a solid body or a hollow body, is combined with a plurality of objects, such as objects 112 or 318, described earlier, to form a mixture. In some implementations, the material is an elastomer. The material used to form the body of the cementing plug is in a flowable state when the plurality of objects are incorporated. At 404, the mixture is poured or otherwise introduced into a mold. In some implementations, one or more of the plurality of objects are made to protrude during molding. In other implementations, in order to generate an irregular surface on the cementing plug, such as irregularly-shaped end surface 114 or irregularly-shaped end surface 320, a portion of the mold may form recesses into which one of the objects is placed. Upon completion of curing of the material within the mold, the plurality of objects residing within the recesses protrude from the formed cementing plug body. In some implementations, the mold may be oriented such that a portion of the mold that forms the irregularly-shaped end surface is oriented vertically downward. With the molding having this orientation, the force of gravity ensures the plurality of objects within the recesses remain in position such that a portion of the plurality of objects protrude from the body of the cementing plug after the mixture has solidified. In other implementations, the mold may be formed such that none of the plurality of objects extend from the body of the solidified cementing plug. At 406, the solidified cementing plug is removed from the mold.

In some implementations, the method may include attaching a base to the cementing plug. For example, in some instances, the method 400 may include inserting the base into the mold prior to introduction of the mixture into the mold. In some implementations, the method 400 may include inserting the base into the mold after insertion of the mixture. In still other implementations, the method 400 may include attaching the base to the solidified cementing plug after the cementing plug is removed from the mold.

Figure 5:
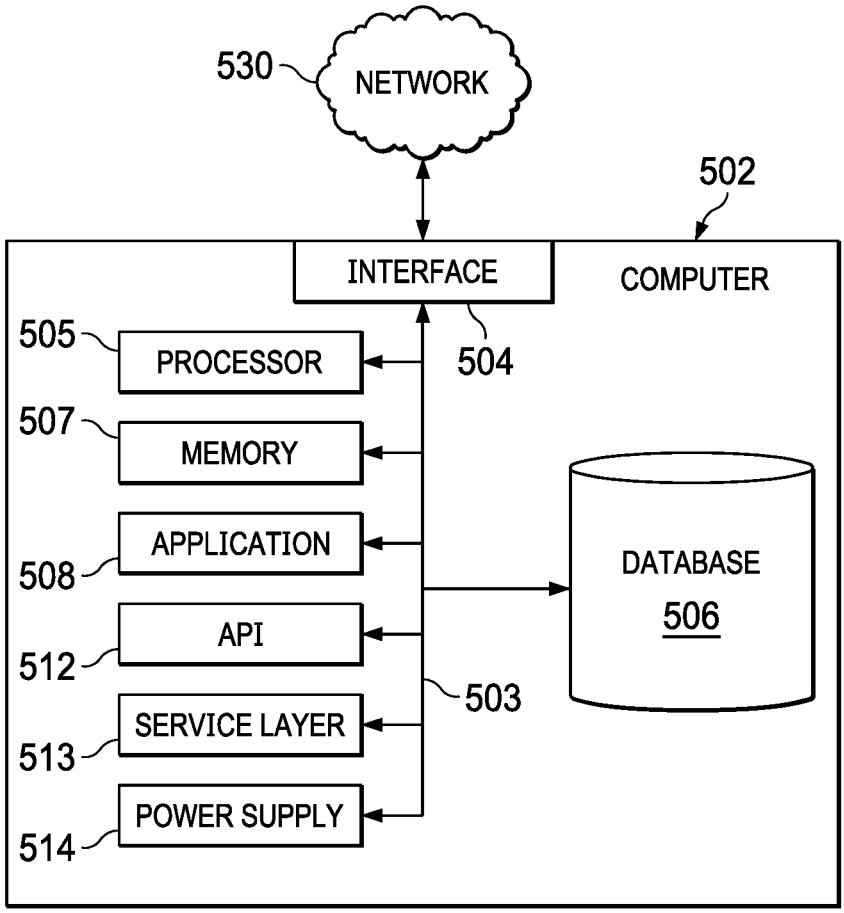
FIG. 5 is a block diagram illustrating an example computer system used to provide computational functionalities associated with described algorithms, methods, functions, processes, flows, and procedures as described in the present disclosure, according to some implementations of the present disclosure.

FIG. 5 is a block diagram of an example computer system 500 used to provide computational functionalities associated with described algorithms, methods, functions, processes, flows, and procedures described in the present disclosure, according to some implementations of the present disclosure. The illustrated computer 502 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 502 can include input devices such as keypads, keyboards, and touch screens that can accept user information. Also, the computer 502 can include output devices that can convey information associated with the operation of the computer 502. The information can include digital data, visual data, audio information, or a combination of information. The information can be presented in a graphical user interface (UI) (or GUI).

The computer 502 can serve in a role as a client, a network component, a server, a database, a persistency, or components of a computer system for performing the subject matter described in the present disclosure. The illustrated computer 502 is communicably coupled with a network 530. In some implementations, one or more components of the computer 502 can be configured to operate within different environments, including cloud-computing-based environments, local environments, global environments, and combinations of environments.

At a high level, the computer 502 is an electronic computing device operable to receive, transmit, process, store, and manage data and information associated with the described subject matter. According to some implementations, the computer 502 can also include, or be communicably coupled with, an application server, an email server, a web server, a caching server, a streaming data server, or a combination of servers.

The computer 502 can receive requests over network 530 from a client application (for example, executing on another computer 502). The computer 502 can respond to the received requests by processing the received requests using software applications. Requests can also be sent to the computer 502 from internal users (for example, from a command console), external (or third) parties, automated applications, entities, individuals, systems, and computers.

Each of the components of the computer 502 can communicate using a system bus 503. In some implementations, any or all of the components of the computer 502, including hardware or software components, can interface with each other or the interface 504 (or a combination of both), over the system bus 503. Interfaces can use an application programming interface (API) 512, a service layer 513, or a combination of the API 512 and service layer 513. The API 512 can include specifications for routines, data structures, and object classes. The API 512 can be either computer-language independent or dependent. The API 512 can refer to a complete interface, a single function, or a set of APIs.

The service layer 513 can provide software services to the computer 502 and other components (whether illustrated or not) that are communicably coupled to the computer 502. The functionality of the computer 502 can be accessible for all service consumers using this service layer. Software services, such as those provided by the service layer 513, can provide reusable, defined functionalities through a defined interface. For example, the interface can be software written in JAVA, C++, or a language providing data in extensible markup language (XML) format. While illustrated as an integrated component of the computer 502, in alternative implementations, the API 512 or the service layer 513 can be stand-alone components in relation to other components of the computer 502 and other components communicably coupled to the computer 502. Moreover, any or all parts of the API 512 or the service layer 513 can be implemented as child or sub-modules of another software module, enterprise application, or hardware module without departing from the scope of the present disclosure.

The computer 502 includes an interface 504. Although illustrated as a single interface 504 in FIG. 5, two or more interfaces 504 can be used according to particular needs, desires, or particular implementations of the computer 502 and the described functionality. The interface 504 can be used by the computer 502 for communicating with other systems that are connected to the network 530 (whether illustrated or not) in a distributed environment. Generally, the interface 504 can include, or be implemented using, logic encoded in software or hardware (or a combination of software and hardware) operable to communicate with the network 530. More specifically, the interface 504 can include software supporting one or more communication protocols associated with communications. As such, the network 530 or the interface's hardware can be operable to communicate physical signals within and outside of the illustrated computer 502.

The computer 502 includes a processor 505. Although illustrated as a single processor 505 in FIG. 5, two or more processors 505 can be used according to particular needs, desires, or particular implementations of the computer 502 and the described functionality. Generally, the processor 505 can execute instructions and can manipulate data to perform the operations of the computer 502, including operations using algorithms, methods, functions, processes, flows, and procedures as described in the present disclosure.

The computer 502 also includes a database 506 that can hold data for the computer 502 and other components connected to the network 530 (whether illustrated or not). For example, database 506 can be an in-memory, conventional, or a database storing data consistent with the present disclosure. In some implementations, database 506 can be a combination of two or more different database types (for example, hybrid in-memory and conventional databases) according to particular needs, desires, or particular implementations of the computer 502 and the described functionality. Although illustrated as a single database 506 in FIG. 5, two or more databases (of the same, different, or combination of types) can be used according to particular needs, desires, or particular implementations of the computer 502 and the described functionality. While database 506 is illustrated as an internal component of the computer 502, in alternative implementations, database 506 can be external to the computer 502.

The computer 502 also includes a memory 507 that can hold data for the computer 502 or a combination of components connected to the network 530 (whether illustrated or not). Memory 507 can store any data consistent with the present disclosure. In some implementations, memory 507 can be a combination of two or more different types of memory (for example, a combination of semiconductor and magnetic storage) according to particular needs, desires, or particular implementations of the computer 502 and the described functionality. Although illustrated as a single memory 507 in FIG. 5, two or more memories 507 (of the same, different, or combination of types) can be used according to particular needs, desires, or particular implementations of the computer 502 and the described functionality. While memory 507 is illustrated as an internal component of the computer 502, in alternative implementations, memory 507 can be external to the computer 502.

The application 508 can be an algorithmic software engine providing functionality according to particular needs, desires, or particular implementations of the computer 502 and the described functionality. For example, application 508 can serve as one or more components, modules, or applications. Further, although illustrated as a single application 508, the application 508 can be implemented as multiple applications 508 on the computer 502. In addition, although illustrated as internal to the computer 502, in alternative implementations, the application 508 can be external to the computer 502.

The computer 502 can also include a power supply 514. The power supply 514 can include a rechargeable or non-rechargeable battery that can be configured to be either user- or non-user-replaceable. In some implementations, the power supply 514 can include power-conversion and management circuits, including recharging, standby, and power management functionalities. In some implementations, the power-supply 514 can include a power plug to allow the computer 502 to be plugged into a wall socket or a power source to, for example, power the computer 502 or recharge a rechargeable battery.

There can be any number of computers 502 associated with, or external to, a computer system containing computer 502, with each computer 502 communicating over network 530. Further, the terms "client," "user," and other appropriate terminology can be used interchangeably, as appropriate, without departing from the scope of the present disclosure. Moreover, the present disclosure contemplates that many users can use one computer 502 and one user can use multiple computers 502.

Described implementations of the subject matter can include one or more features, alone or in combination.

For example, in a first implementation, a non-transitory, computer-readable medium storing one or more instructions executable by a computer system to perform operations including: incorporating a plurality of objects formed from a rigid polymeric material into a flowable elastomer to form a mixture; introducing the mixture into a mold such that the plurality of objects are distributed within the mixture; solidifying the mixture into a cementing plug; and removing the cementing plug from the mold.

The foregoing and other described implementations can each, optionally, include one or more of the following features:

A first feature, combinable with any of the following features, the method further including: causing at least one of the plurality of objects to protrude from a surface of the cementing plug.

A second feature, combinable with any of the previous or following features, where at least a portion of the plurality of objects are irregularly-shaped.

A third feature, combinable with any of the previous or following features, where at least a portion of the plurality of objects are randomly distributed within the body.

A fourth feature, combinable with any of the previous or following features, where at least a portion of the plurality of objects are uniformly-shaped.

A fifth feature, combinable with any of the previous or following features, where the plurality of objects are formed from Bakelite.

A sixth feature, combinable with any of the previous features, where the cementing plug defines a central passage.

In a second implementation, a computer-implemented system, including one or more processors and a non-transitory computer-readable storage medium coupled to the one or more processors and storing programming instructions for execution by the one or more processors, the programming instructions instructing the one or more processors to perform operations including: incorporating a plurality of objects formed from a rigid polymeric material into a flowable elastomer to form a mixture; introducing the mixture into a mold such that the plurality of objects are distributed within the mixture; solidifying the mixture into a cementing plug; and removing the cementing plug from the mold.

The foregoing and other described implementations can each, optionally, include one or more of the following features:

A first feature, combinable with any of the following features, further including programming instructions operable to instruct the one or more processors to perform operations including causing at least one of the plurality of objects to protrude from a surface of the cementing plug.

A second feature, combinable with any of the previous or following features, where at least a portion of the plurality of objects are irregularly-shaped.

A third feature, combinable with any of the previous or following features, where at least a portion of the plurality of objects are randomly distributed within the body.

A fourth feature, combinable with any of the previous or following features, where at least a portion of the plurality of objects are uniformly-shaped.

A fifth feature, combinable with any of the previous or following features, where the plurality of objects are formed from Bakelite.

A sixth feature, combinable with any of the previous features, where the cementing plug defines a central passage.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY.

The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A cementing plug for introduction into a wellbore casing during a cementing operation, the cementing plug comprising:

a body formed from an elastomer; and a plurality of objects embedded within the body, the plurality of objects formed from Bakelite, wherein at least a portion of the plurality of objects are irregularly-shaped, wherein at least a portion of the plurality of objects are randomly distributed within the body.

2. The cementing plug of claim 1, wherein one or more of the plurality of the objects protrude from a surface of the body.

3. The cementing plug of claim 1, wherein the body comprises a first flared end.

4. The cementing plug of claim 3, wherein one or more of the plurality of objects protrude from a surface formed at the first flared end.

5. The cementing plug of claim 1, wherein at least a portion of the plurality of objects are uniformly-shaped.

6. The cementing plug of claim 1, wherein the body comprises a second flared end.

7. The cementing plug of claim 1, further comprising a base provided at an end of the body.

8. The cementing plug of claim 7, wherein the base is formed from Bakelite.

9. The cementing plug of claim 1, wherein the body comprises a plurality of annular rings.

10. The cementing plug of claim 1, wherein the body defines a central passage.

* * * * *